US007270588B2

(12) United States Patent
Frazier et al.

(10) Patent No.: US 7,270,588 B2
(45) Date of Patent: Sep. 18, 2007

(54) FLYING DISC

(76) Inventors: John K. Frazier, 3191 Stanwood La., Lafayette, CA (US) 94549; David L. Sasse, 3191 Stanwood La., Lafayette, CA (US) 94549

( * ) Notice: Subject to any disclaimer, the term of this patent is extended or adjusted under 35 U.S.C. 154(b) by 0 days.

(21) Appl. No.: 11/029,665

(22) Filed: Jan. 3, 2005

(65) Prior Publication Data

US 2006/0148372 A1 Jul. 6, 2006

(51) Int. Cl.
*A63H 27/127* (2006.01)

(52) U.S. Cl. ..... 446/46; 446/48; 473/589

(58) Field of Classification Search ..... 446/46, 446/48; 473/589, 590
See application file for complete search history.

(56) References Cited

U.S. PATENT DOCUMENTS 4,302,901 A * 12/1981 Psyras ..... 446/46
5,277,641 A * 1/1994 Gable et al. ..... 446/46
5,393,256 A * 2/1995 Mitchell et al. ..... 446/15
5,882,239 A * 3/1999 Trichak ..... 446/46

* cited by examiner

*Primary Examiner*—Kien Nguyen
(74) *Attorney, Agent, or Firm*—Jill L. Robinson

(57) ABSTRACT

A flying disc toy of flexible plastic construction with a convex central top section connected to a concave central bottom section by an annular rim. The toy has a central hollow area that can be filled with water through a central opening in the top plate and also has a plurality of openings on the annular rim. When the toy is thrown and flies in the rotating manner similar to most flying discs, the centrifugal forces produced will cause the water inside of the toy to spray out of the openings in the annular rim.

5 Claims, 3 Drawing Sheets

FLYING DISC

TECHNICAL FIELD

The invention relates to toy flying discs.

BACKGROUND—DESCRIPTION OF PRIOR ART

Flying disc toys for throwing and catching have been around for many years, and the prior art describes flying discs used for throwing and catching and for games related to these type toys. The most commonly known flying disc is the FRISBEE invented by Headrick, U.S. Pat. No. 3,359,678. Many different games have been developed that use a flying disc, including "Disc Golf" and "Ultimate FRISBEE".

Over the years different designs of the flying discs have been developed to produce better aerodynamic properties, lift and stability, with modifications related to an airfoil rim as noted in the flying disc described by Alder, U.S. Pat. No. 6,179,737. There have been improvements in the flying disc to make the toys easier to both throw and catch.

It is the object of the present invention to provide a flying disc that will spray water when thrown.

SUMMARY OF THE INVENTION

The present invention relates to a flying disc that when filled with water and thrown with in the normal fashion consistent with flying discs will, by the centrifugal forces generated, propel water outward through openings in the lateral surface of the flying disc. This new invention is to be used at the swimming pool, lake, river or even the ocean. The toy can also be filled using a backyard hose and subsequently thrown for fun and enjoyment.

This new flying disc has a principal function to provide a toy that contains a reservoir such that that when the reservoir is filled with water and the disc is thrown in the usual fashion of flying discs water is propelled from the toy. In one embodiment the disc is hollow and made of unitary construction with a top convex surface and a bottom concave surface connected by an annular rim, the upper part of the rim connected to the top convex surface and the bottom part of the rim connected to the bottom convex surface. The disc has a central opening on the convex surface and a plurality of openings on the annular rim, which are preferably located above the midline between the top surface and the bottom surface. This toy, when filled with water and thrown, will, as a result of the centripetal forces generated, disperse and propel the water in a horizontal plane relative to the central axis of the flying disc.

The use and advantages of the invention are more particularly described below.

DETAILED DESCRIPTION OF THE PREFERRED EMBODIMENT

Figure 1:
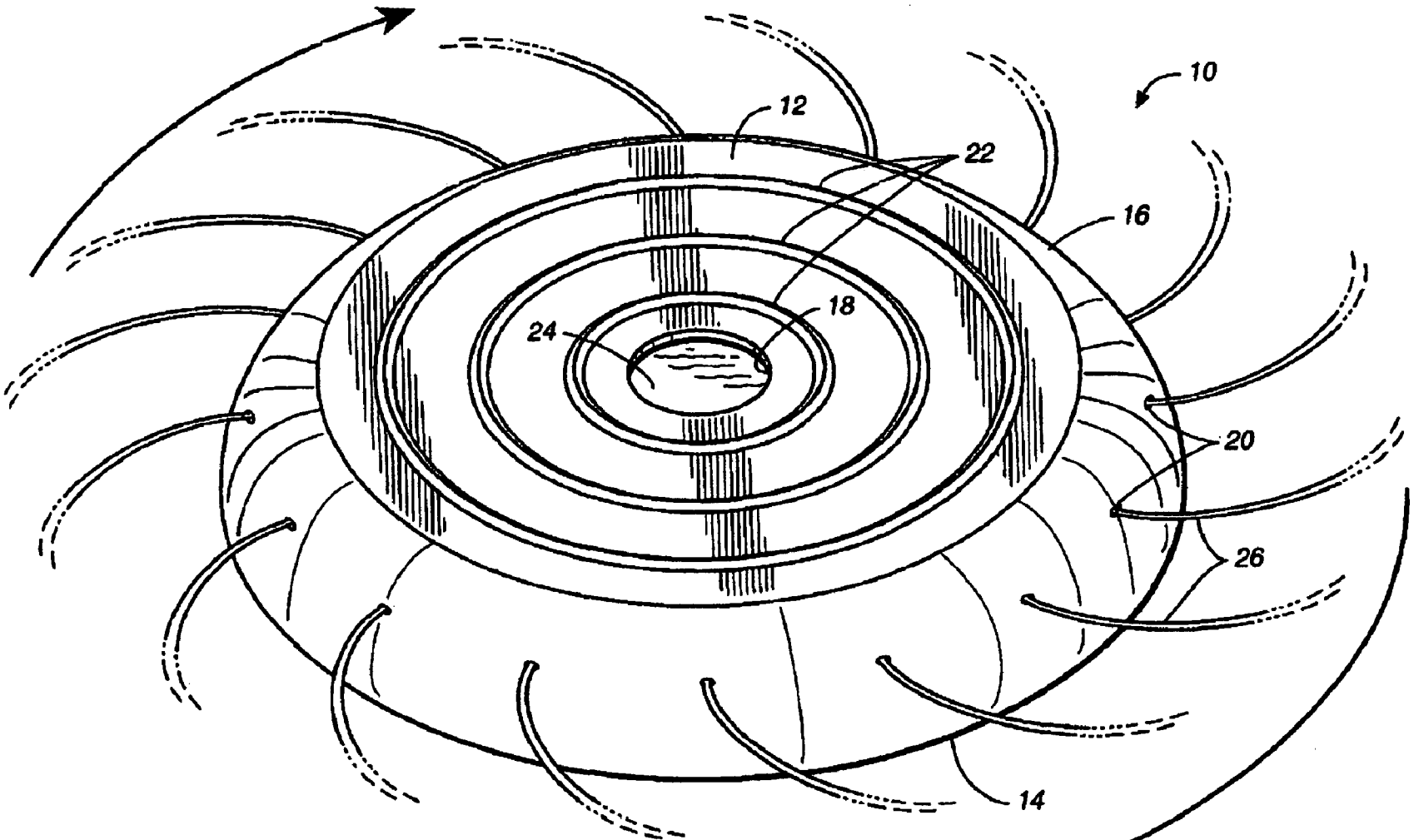
FIG. 1 is a perspective view of the invention.

A flying disc as seen in FIGS. 1-5 is illustrated in accordance with the invention. This figure is an elevated perspective view of the flying saucer shaped flying disc 10. As seen in FIG. 1 this disc may include a convex top surface 12 and an annular rim 16 giving the invention the design of a flying saucer. A plurality of ridges 22 may be located on the top surface 12 to act as a spoiler and disrupt the flow of air over the top surface to promote stability while in flight. The concave bottom surface 14 is shaped so that the flying disc has the shape of an airfoil to promote lift when the invention is thrown. The annular rim 16 connects the convex top surface 12 with the concave bottom surface 14. The top surface 12, bottom surface 14 and annular rim 16 may be of unitary construction. It will be understood by those of ordinary skill in the art that alternative constructions are possible that will still allow the disc to fly appropriately when thrown.

The space formed by the top surface 12, bottom surface 14 and annular rim 16 creates a reservoir in the hollow interior of the disc. It should be understood that alternative reservoir constructions are possible. A plurality of openings 20 are located circumferentially along the annular rim 16 and communicate with the reservoir. The openings 20 are preferably located above the midline of the annular rim in order to prevent water from leaking out of the invention when the reservoir is filled but before the toy is thrown. The openings 20 are of an appropriate size to allow the water to be sprayed 26 out of the flying disc when thrown and are spaced at an appropriate distance circumferentially around the annular rim 16 of the invention, and may be equidistant from each other. Although the opening may take the form of small holes on the order of a few millimeters, it will be understood that the openings may be formed with different shapes and/or moldings and/or larger to adjust the spray of water.

Figure 2:
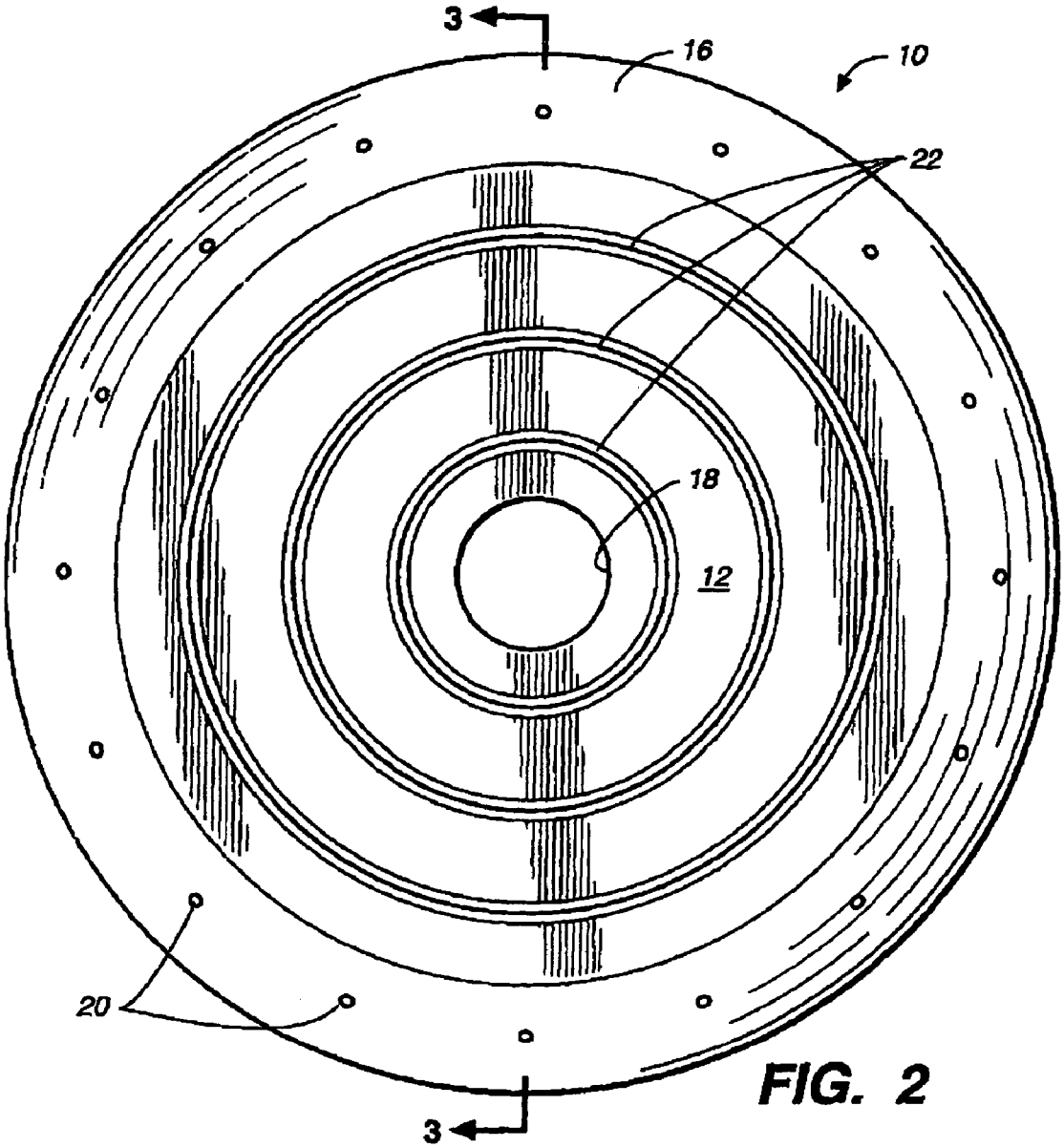
FIG. 2 is a perspective view of the invention from the top.

In this embodiment, a larger opening 18 is centrally located on the disc to allow the invention to be quickly filled with water 24. FIG. 2 shows the top surface 12 of the invention and the central opening 18. This opening 18 is of the appropriate size in order to allow the invention to be filled rapidly when submerged or when filled from a faucet or hose.

Figure 3:
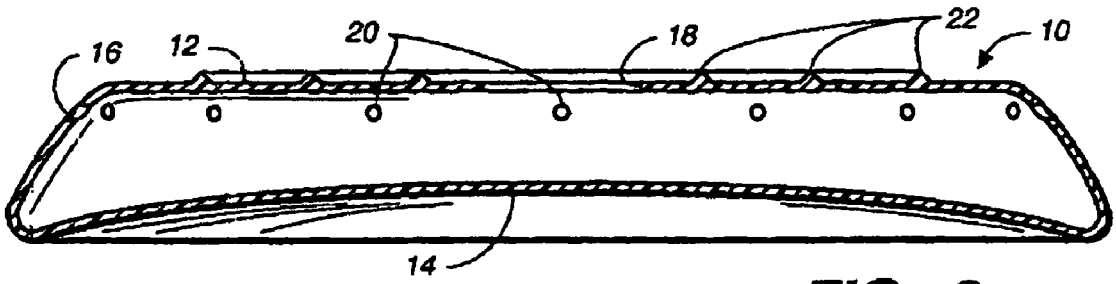
FIG. 3 is a cross sectional view of the invention

FIG. 3 shows a cross section of the annular rim 16 connected or molded to the convex top surface 12 and the concave bottom surface 14.

Figure 4:
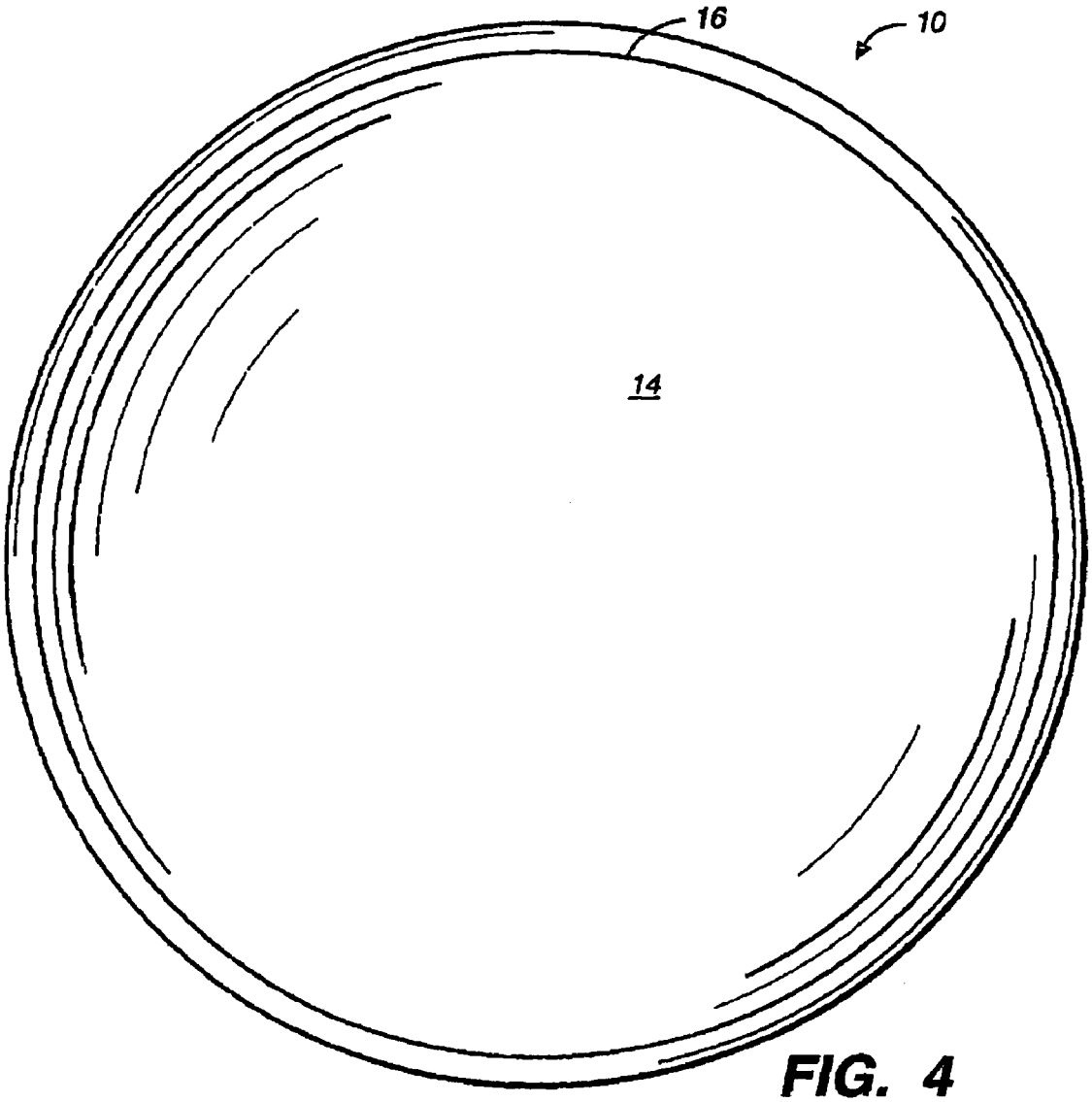
FIG. 4 is a bottom view of the invention

The bottom of an embodiment of the toy is seen in FIG. 4. This is preferably a smooth surface 14 that is connected or molded to the annular rim 16. This bottom surface 14 may be slightly concave to allow the water inside to be directed to the periphery of the invention. Additionally, the concavity acts as an airfoil when the invention is thrown to promote lift.

Figure 5:
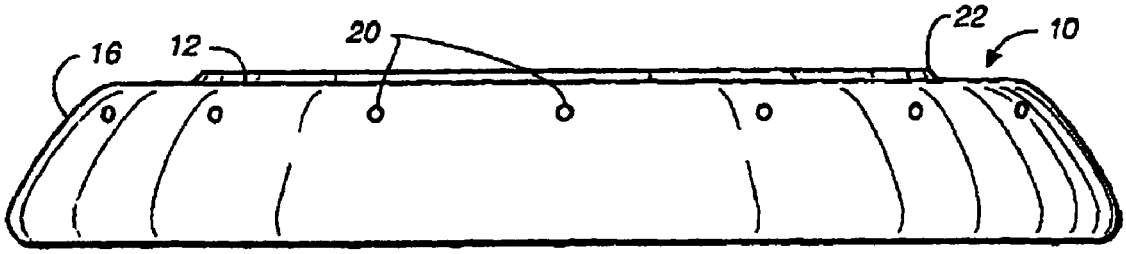
FIG. 5 is a side view of the invention

FIG. 5 shows a horizontal view of the invention shows the convex top surface 12 with the series of ridges 22 connected to the bottom surface 14 by the annular rim 16.

The invention may be made of plastic materials such as polypropylene, or more preferably polyethylene, most preferably with a density slightly less than that of water so as to allow the toy to float when used around swimming pools, lakes or rivers.

The invention may be thrown either empty without fluid in the inner cavity. When filled and throw, the toy preferably sprays water 24 in a planar horizontal direction. Ideally the disc will create a wide spray 26 of water and will also spray the users when they catch the disc at the conclusion of its flight.

The invention may be embodied in other specific forms without departing form the spirit or essential properties. An example of this would be to change the bottom surface 14 to either flat or slightly convex. Another example would be changing to position of the openings 20 or their form or size on the annular rim 16 or changing the size or the number of openings 18 on the top surface 12 of the invention. Additionally, alternative means for providing a reservoir could allow either the bottom surface or top surface as shown to be dispensed with.

What is claimed is:

1. A flying disc toy adapted for being thrown in a rotating fashion comprising:

a substantially circular top surface;

a substantially circular bottom surface; and a substantially circular annular rim region having a top edge and a bottom edge, wherein the top surface is connected to the top edge of the annular rim and the bottom surface connected to the bottom edge of the annular rim; the annular rim defines a midline between the top edge and the bottom edge; and the top surface, the bottom surface and the annular rim together define an open space adapted to be filled with water and wherein the top surface has an opening adapted for receiving water in communication with the open space; and wherein the annular rim has a plurality of openings located at specific intervals around the rim above the midline of the annular rim between the top edge and the bottom edge, whereby when the open space is filled with water and the toy is thrown, water is ejected through the openings producing a spray.

2. A flying disc as in claim 1 wherein the top surface is substantially convex.

3. A flying disc as in claim 1 wherein the bottom surface is substantially concave.

4. A flying disc as in claim 1 wherein the top surface further forms a series of ridges whereby the flow of air over the top surface is disrupted to promote stability of the flying disc in flight.

5. A flying disc as in claim 1 wherein the disc is of unitary construction so that the top surface, the annular rim and the bottom surface together define a hollow unit with exactly one open space.

* * * * *